US010117455B2

(12) United States Patent
Beckmann et al.

(10) Patent No.: US 10,117,455 B2
(45) Date of Patent: Nov. 6, 2018

(54) CUTTING APPARATUS FOR USE IN THE TOBACCO INDUSTRY

(71) Applicant: British American Tobacco (Investments) Limited, London (GB)

(72) Inventors: Frank Beckmann, Hamburg (DE); Winfried Böttcher, Hamburg (DE); Andrew Bray, London (GB); Gary Fallon, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 369 days.

(21) Appl. No.: 14/437,606

(22) PCT Filed: Oct. 22, 2013

(86) PCT No.: PCT/GB2013/052752

§ 371 (c)(1),
(2) Date: Apr. 22, 2015

(87) PCT Pub. No.: WO2014/064433

PCT Pub. Date: May 1, 2014

(65) Prior Publication Data

US 2015/0272205 A1 Oct. 1, 2015

(30) Foreign Application Priority Data

Oct. 22, 2012 (GB) ..... 1218970
Mar. 27, 2013 (GB) ..... 1305625.4

(51) Int. Cl.
*A24C 5/47* (2006.01)
*A24C 5/00* (2006.01)
(Continued)

(52) U.S. Cl.
CPC ..... *A24C 5/473* (2013.01); *A24C 5/005* (2013.01); *A24C 5/10* (2013.01); *B26D 1/405* (2013.01);
(Continued)

(58) Field of Classification Search
None
See application file for complete search history.

(56) References Cited

U.S. PATENT DOCUMENTS 3,036,581 A 5/1962 Dearsley
4,334,449 A * 6/1982 Hinz ..... A24C 5/473 83/342

(Continued)

FOREIGN PATENT DOCUMENTS

EP 2070666 6/2009
GB 872046 7/1961

(Continued)

OTHER PUBLICATIONS

International Searching Authority; Notification of the Transmittal of the International Search Report and the Written Opinion of the International Searching Authority, or the Declaration; dated Jan. 20, 2014; Europe.

*Primary Examiner* — Michael J Felton
*Assistant Examiner* — Katherine Will
(74) *Attorney, Agent, or Firm* — Cantor Colburn LLP

(57) ABSTRACT

A rotary shear cutting apparatus to cut discrete non-rectangular portions from a web of smoking article sheet material, comprises a first rotary carrier provided with a first cutting edge and a second rotary carrier provided with a second cutting edge, wherein said first and second cutting edges are configured to cooperate during rotation of said first and second rotary carriers to cut a non-rectangular portion from the web.

30 Claims, 7 Drawing Sheets

(51) Int. Cl.
*A24C 5/10* (2006.01)
*B26D 1/40* (2006.01)

(52) U.S. Cl.
CPC ..... *Y10T 83/483* (2015.04); *Y10T 83/4844* (2015.04)

(56) References Cited

U.S. PATENT DOCUMENTS

| | | | | |
|---|---|---|---|---|
| 4,893,641 | A * | 1/1990 | Strickland | B26B 21/40 128/898 |
| 4,943,341 | A | 7/1990 | Mattei | |
| 2005/0166733 | A1 * | 8/2005 | Piscitello | B26D 3/10 83/37 |

FOREIGN PATENT DOCUMENTS

| | | | |
|---|---|---|---|
| GB | 1370878 | A | 10/1974 |
| GB | 2123737 | A | 2/1984 |
| JP | 2005058232 | A | 3/2005 |
| WO | 2010142498 | | 12/2010 |

* cited by examiner

CUTTING APPARATUS FOR USE IN THE TOBACCO INDUSTRY

CROSS REFERENCE TO PRIOR APPLICATION

This application is a national stage application filing under 35 U.S.C. § 371 of and claims benefit under 35 USC § 365(c) to PCT/GB2013/052752, filed on Oct. 22, 2013, which claims priority to and benefit of Great Britain Patent Application No. 1218970.0, filed on Oct. 22, 2012 and Great Britain Patent Application No. 1305625.4 filed Mar. 27, 2013.

FIELD

This disclosure relates to tobacco industry machinery. In particular, but not exclusively, it relates to a rotary shear cutting apparatus to cut discrete patches from a web of smoking article sheet material such as cigarette tipping paper.

BACKGROUND

In the manufacture of cigarettes, a double-length cigarette may be formed by positioning a double-length filter plug between the ends of two plain cigarette rods in a flute of a rotary assembly drum and securing the cigarette rods to the filter plug by means of a cigarette tipping paper patch. The patch may have the appearance of cork. The double-length cigarette may then be cut through the filter plug to form two filter tipped cigarettes.

The tipping paper patches are rectangular blanks coated on one side with an adhesive and may be cut from a continuous cigarette paper web at a location upstream of the assembly drum. The rectangular blanks may be cut by a known rotary shear cutting apparatus comprising two rotary drums respectively mounted with a straight edged knife and a straight edged counter knife. The web of cigarette paper is cut through with a shearing action similar to scissors as it is fed between the knife and counter knife during rotation of the rotary carriers. Each cut forms a straight trailing edge of one rectangular blank and the straight leading edge of the following rectangular blank.

SUMMARY

The present invention provides a tobacco industry apparatus comprising a rotary shear cutting apparatus to cut discrete non-rectangular portions from a web of smoking article sheet material. The rotary shear cutting apparatus comprises a first rotary carrier provided with a first cutting edge and a second rotary carrier provided with a second cutting edge. The first and second cutting edges are configured to cooperate during rotation of the first and second rotary carriers to cut a non-rectangular portion from the web.

In embodiments, the first and second cutting edges cooperate to provide a contoured cut.

At least one of the first and second cutting edges may be shaped such that the cutting edges cooperate during rotation of the rotary carriers to shear through the web to define said non-rectangular portion. The cutting edge may comprise angled sections or may be otherwise contoured along its length. In some embodiments, the cutting edge may have one or more interruptions along its length at which the cutting edge bends or otherwise changes direction.

Alternatively, or in addition, at least one of the cutting edges may be defined by a blade which is angle-mounted on its respective carrier. By virtue of the angle-mounting, the cutting edge is arranged at a particular fixed orientation relative to the carrier so as to cooperate with its counterpart cutting edge to shear through the web to define the non-rectangular portions.

In various embodiments, at least one of said cutting edges is defined by a blade which is shaped to define one or more spaces (e.g: slots formed in the blade) to provide flexibility to the blade. The improved flexibility acts to compensate for the stiffness which may result from the provision of angles/bends in the cutting edge.

Alternatively, or in addition the blade may include a resilient flat portion between the carrier and the cutting edge to provide flexibility to the blade. Alternatively, or in addition, at least one the rotary carriers may include a resilient support to which a respective blade is mounted so as to improve flexibility.

These measures to improve flexibility may be provided individually or in combination to compensate for any inherent stiffness resulting from the shape of the blade.

The web of smoking article sheet material may have a width which does not vary along its length. The web of smoking article sheet material may comprise a web of tipping paper and the non-rectangular portion which is cut from the web may comprise a tipping paper patch. The tipping paper patch may be used as a wrapper in smoking article assembly to join rod articles to one another, e.g: at a rolling drum downstream of the rotary shear cutting apparatus.

According to various embodiments, the width of the non-rectangular patch becomes smaller towards the leading or trailing edge of the patch. This facilitates rolling the patch at the rolling drum, since rolling can start at a region of narrower width such that the patch is kept wrinkle-free during rolling, even for very wide tipping patches.

The present invention also provides an apparatus for assembling smoking articles comprising a rotary shear cutting apparatus as defined in any of claims 1-27 appended hereto.

The present invention also provides an apparatus for assembling smoking articles having one or more sheet material wrappers, comprising a rotary shear cutting apparatus as claimed in any preceding claim, and a wrapping device configured to receive a non-rectangular portion of sheet material cut by said rotary shear cutting apparatus, wherein said wrapping device is configured to wrap said non-rectangular portion of sheet material to form a wrapped layer of said smoking article.

BRIEF DESCRIPTION OF THE DRAWINGS

So that the invention may be more fully understood, embodiments thereof will now be described by way of example only, with reference to the accompanying drawings, in which.

DETAILED DESCRIPTION

Figure 1:
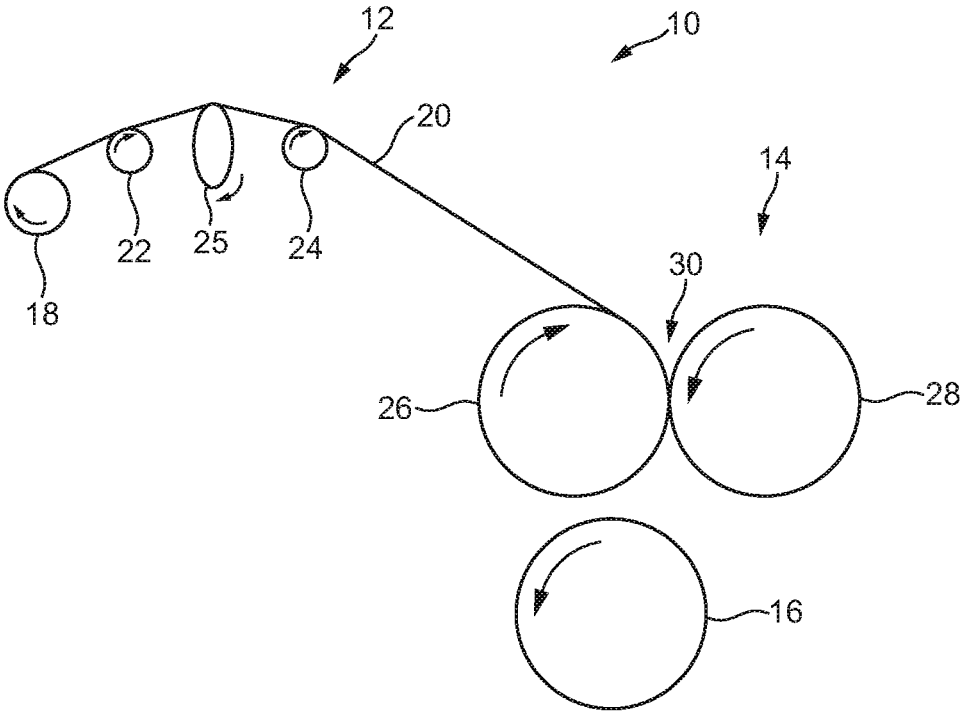
FIG. 1 is a schematic illustration of a portion of a cigarette making machine including a cutting apparatus.
Figure 2:
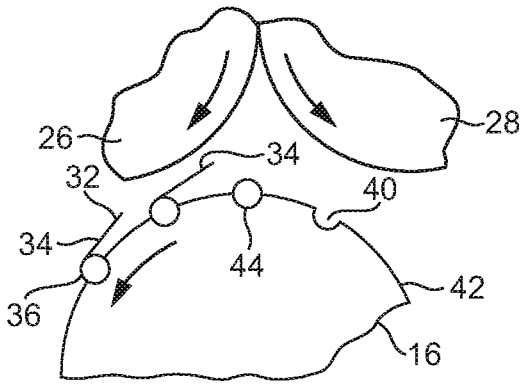
FIG. 2 is an enlarged view of a portion of FIG. 1.

Referring to FIGS. 1 and 2, a portion of a cigarette assembly machine 10 comprises a web feeder 12, a cutting apparatus 14 and a rotary assembly drum 16. The web feeder 12 comprises a reel 18 holding a supply of a cigarette tipping paper in the form of a continuous web 20, a pair of guide rolls 22, 24 and an oscillator 25 disposed intermediate the guide rolls. The cutting apparatus 14 comprises a first rotary carrier 26 and a second rotary carrier 28. A nip 30 is defined between the first and second rotary carriers 26, 28. The web 20 of cigarette tipping paper is fed into the nip 30 where respective cutting edges (not shown in FIGS. 1 and 2) cooperate to make a transverse cut through the web. Each cut forms the trailing edge 32 of a portion, or blank 34, of cigarette paper that is separated from the web 20 and the leading edge 36 of the following blank. The oscillator 25 is configured to vary the feed of the web 20 into the nip 30 so that the blanks 34 can be accelerated away from the leading end of the web to ensure reliable separation of the cut blank from the web. The oscillator 25 also determines the length of the blank. The first rotary carrier 26 has suction holes (not shown in FIGS. 1 and 2) provided in its surface to hold the separated blanks 34 in place. An adhesive applicator (not shown) is provided upstream of the nip 30 to apply an adhesive, such as a cold melt (PVA), to a surface of the web 20.

As shown in FIG. 2, the assembly drum 16 comprises a plurality of flutes, or grooves, 40 provided in its peripheral surface 42. The flutes 40 extend across the width of the assembly drum 16 parallel to its axis of rotation. Each flute 40 is provided with suction holes for the application of suction pressure to assist in retaining a cigarette rod assembly 44 in the flute. The cigarette rod assembly 44 may comprise a double length filter plug disposed between the facing ends of two plain cigarette rods. As each cigarette rod assembly 44 is swept past the first rotary carrier 26, the periphery of the cigarette rod assembly comes into contact with a cigarette paper blank 34. Contact is made with the adhesive coated side of the blanks, which become tangentially attached to the periphery of the cigarette rod assembly 44. Downstream of the point at which the blanks 34 attached to the cigarette rod assemblies 44, the cigarette rod assemblies and attached blanks undergo an assembly process which is well known per se and will not be described in any detail here. Briefly, the rod assemblies and blanks pass under a rolling plate where they are rotated to cause each blank 34 to be rolled around and pressed against the entire circumference of the cigarette rod assembly 44 to which it is attached, thereby completely joining the blank to the cigarette rod assembly and securing the filter plug to the two plain cigarette rods to form a double-length cigarette. This double-length cigarette rod may then be transferred to a further drum (not shown) where the double-length cigarette may be cut through the filter plug to form two individual cigarettes.

Although the assembly process is discussed above in relation to a cigarette rod assembly comprising a double length filter plug disposed between the facing ends of two plain cigarette rods, this is not intended to be limiting. For example, if multi-filter cigarettes are to be assembled, the cigarette rod assembly may alternatively comprise a double length filter rod disposed between two filter tipped cigarettes. In this case, the blank 34 may be rolled around the cigarette rod assembly to join the double length filter plug to the two filter tip cigarettes. The double length filter plug is then cut to form two individual multi-filter cigarettes. Alternatively, in another multi-filter assembly process, a first filter is inserted between two plain tobacco rods, cut and separated, then a second filter is inserted into the gap, and then a tipping blank is applied to combine the rod assembly together. The combined rod assembly is then cut centrally to form two individual multi-filter cigarettes.

Figure 3:
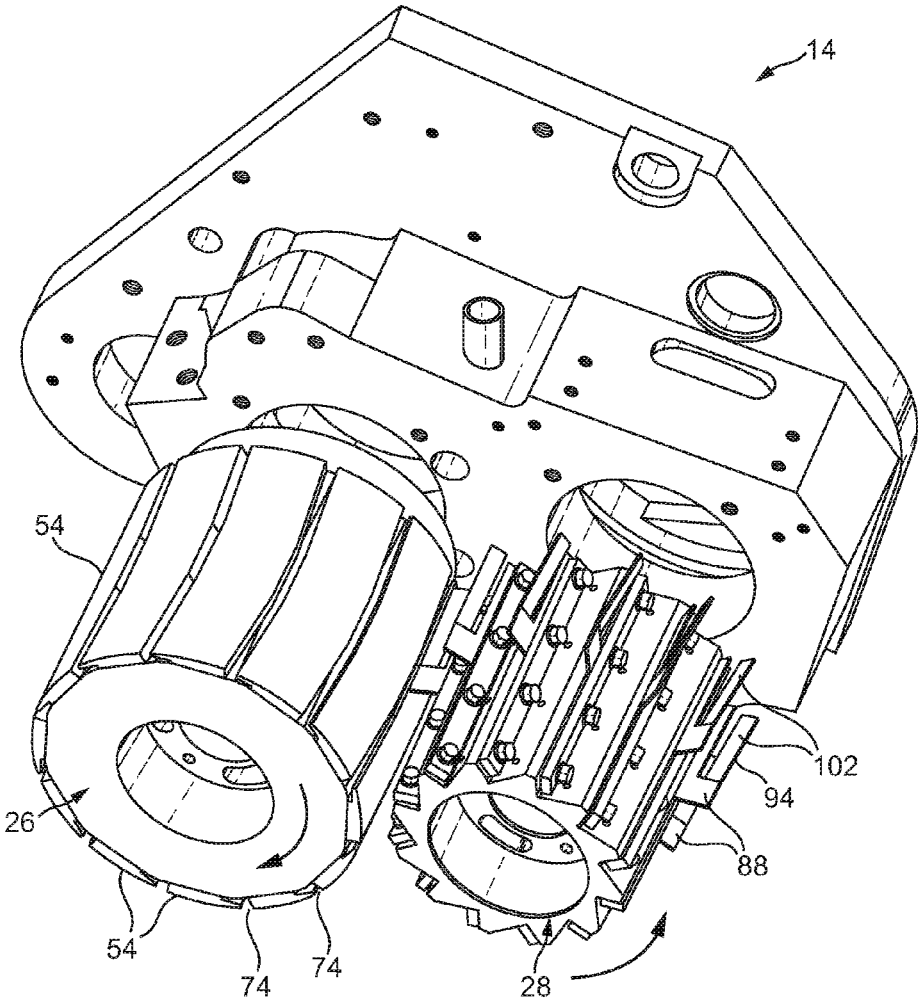
FIG. 3 is a perspective view of a cutting apparatus that may be used in the cigarette making machine of FIG. 1.

FIG. 3 is a perspective view of a cutting apparatus 14 that may be used in the cigarette making machine 10 shown in FIGS. 1 and 2. The cutting apparatus 14 comprises a first rotary carrier 26 and a contra-rotating second rotary carrier 28. The first and second rotary carriers 26, 28 are carried on respective drive shafts (not shown) that define respective axes of rotation for the carriers. The axes of rotation of the first and second rotary carriers 26, 28 are disposed in parallel spaced apart relation. The drive shafts are cantilever mounted and may be fitted with takeoff gears by means of which they may be driven by a mechanical gearbox of the cigarette making machine, or by one or more servo motors.

Figure 4:
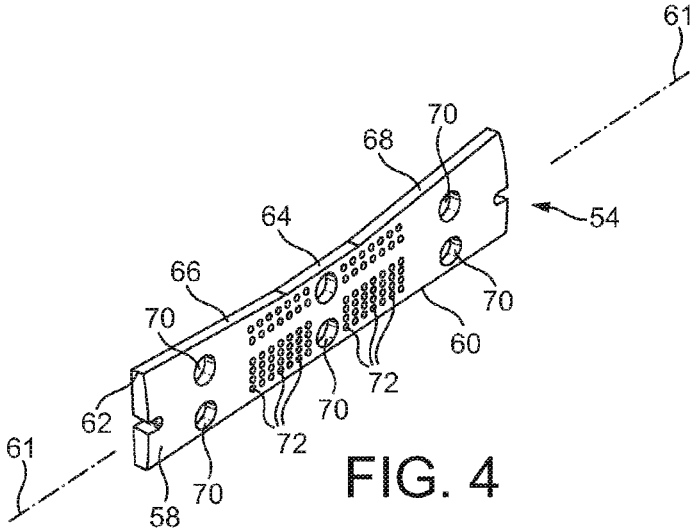
FIG. 4 is a perspective view a cutting blade of the cutting apparatus of FIG. 3.
Figure 5:
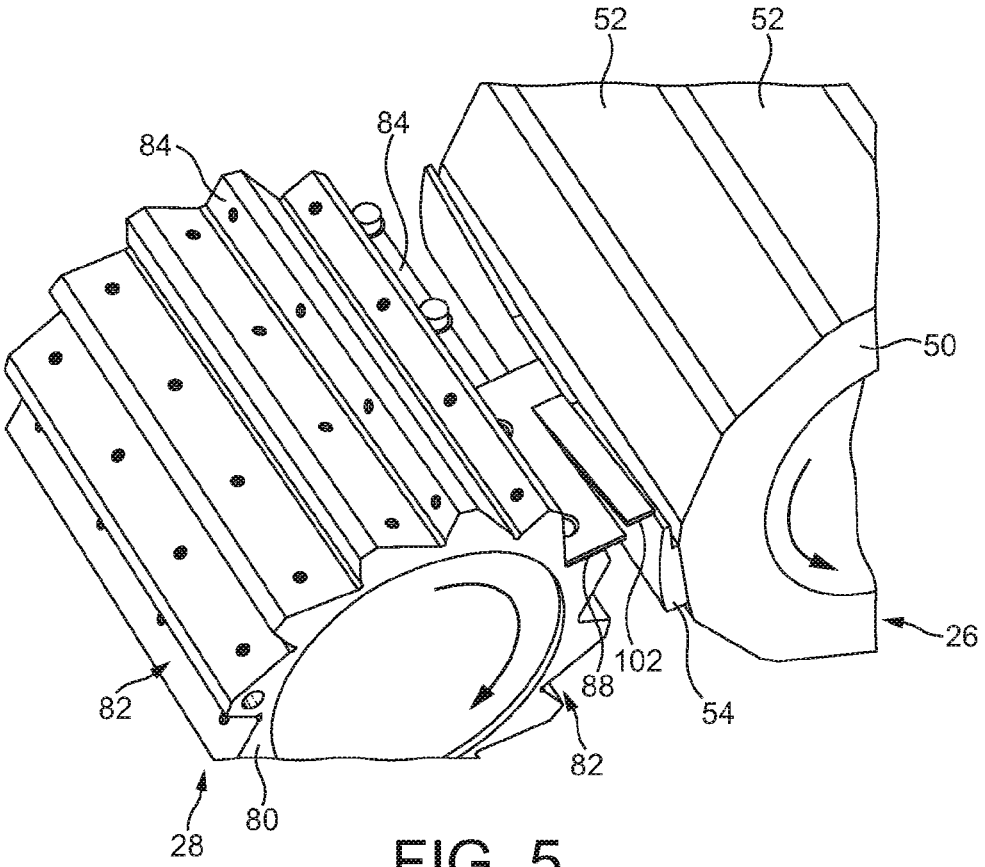
FIG. 5 is an enlargement of a portion of FIG. 3.

Referring particularly to FIGS. 4 and 5, the first rotary carrier 26 comprises a drum 50 that has a plurality of flat faces 52 disposed around its circumference. Respective cutting plates 54 are secured to the flats 52. The cutting plates 54 are elongate members, having a flat bottom face to seat on a flat face 52 of the drum and an arcuate top surface 58. The trailing edge of the cutting plates 54 defines a first cutting edge 62 of the cutting apparatus 14. The first cutting edge 62 comprises a first section 64, a second section 68 and a third section 66. The first section 64 defines a straight edge that extends at least substantially parallel to the longitudinal centreline 61. The second section 68 extends at an angle to the first section 64. The inclination of the second section 68 to the first section is such that its inner end (ie the end that adjoins the first section 64) is disposed closer to the centreline 61 than is its outer end (ie the end disposed furthest from the first section 64). Similarly the third section 66 extends at an angle to the first section 64 and is a mirror image of the second section 68. Although not limited to this value, in the illustrated example the second and third sections both extend at an angle of 5° to the first section. In alternative embodiments, the second and third sections may extend at an angle of 10° to the first section. The first section 64 is disposed between the second and third sections 68, 66, which in the illustrated example are symmetrically disposed with respect to the first section. In the illustrated example the first cutting edge 62 has a shallow flat bottomed V-shaped profile. In the illustrated embodiment, the leading edges 60 of the cutting plates 54 are not cutting edges.

The cutting plates 54 are provided with a plurality of through-holes 70 via which the blades can be releasably secured to the drum 50 by means of screws, bolts or the like.

The cutting plates are also provided with a plurality of apertures 72. The apertures 72 communicate with a system of internal passages in the drum 50 (not shown). A source of suction pressure is applied to the web 20 and blanks 34 via the apertures 72. The configuration of the system that communicates the suction pressure to the apertures 72 is such that the suction pressure is released as the blanks 34 approach the assembly drum 16 so that each blank can reliably attach to a cigarette rod assembly 44. The application of suction pressure in this way will be known to those skilled in the art and so will not be described in further detail herein.

As shown in FIG. 3, when a complete set of cutting plates 54 is fitted to the periphery of the drum 50, a recess 74 is defined between the leading and cutting edges 60, 62 of adjacent cutting plates.

Referring to FIG. 5, the second rotary carrier 28 comprises a drum 80. A plurality of grooves 82 is provided in the periphery of the drum 80. The grooves 82 extend across the full width of the drum 80 and each has an asymmetric V-shaped cross-section. The shorter side of the V-shaped groove 82 defines a support surface 84 for a knife such as the knife 86 shown in FIG. 6. The knife may be a single piece that extends over the entire width of the drum 80. However, in the example illustrated by FIGS. 3 to 7 the knife 86 comprises two blade members 88 that are fixed to the support surface 84 in side-by-side relation to define a continuous second cutting edge 90 of the cutting apparatus 14. In FIGS. 3 and 5, only one blade member 88 of each knife is shown. From a consideration of FIG. 6 it can be seen how two blade members 88 would be fitted to each support surface 84 of the drum 50 as a mirror image of one another to form a plurality of knives 86 disposed in circumferentially spaced apart relation around the periphery of the drum 50.

Figure 6:
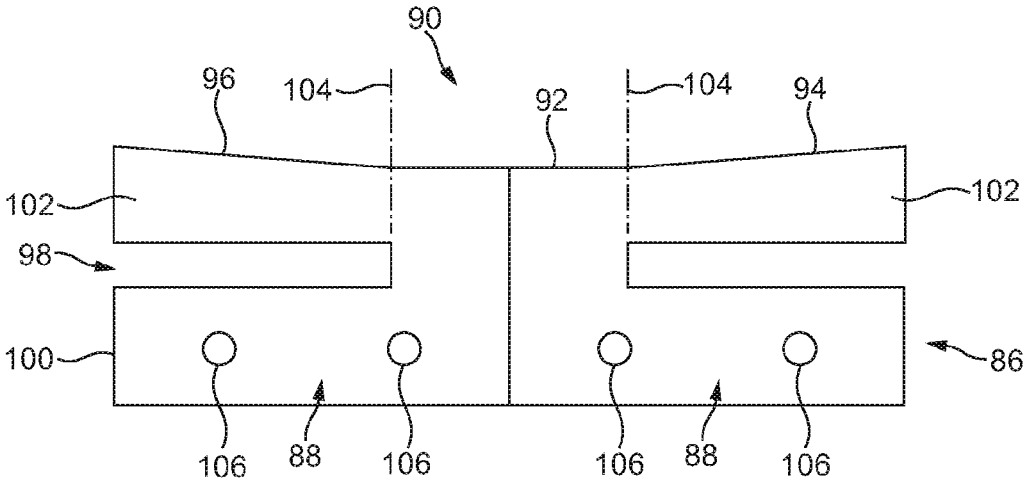
FIG. 6 is a plan view of a knife of the cutting apparatus of FIG. 3.

Referring to FIG. 6, the second cutting edge 90 comprises a first section 92, a second section 94 and a third section 96. The sections 92, 94, 96 are configured such that the second cutting edge has three sections that complement the three sections of the first cutting edge 62. Thus, the second and third sections 94, 96 each extend at an angle of 5° to the first section 92. The first section 92 is disposed between the second and third sections 94, 96, which in the illustrated example are symmetrical with respect to the first section so that the second cutting edge 90 has a shallow flat bottomed V-shaped profile that complements the profile of the first cutting edge 62.

Figure 7:
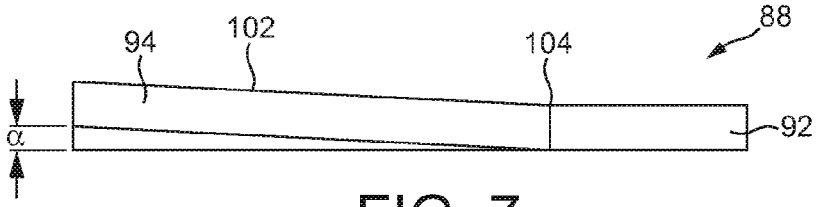
FIG. 7 is a front elevation of a blade member of the knife of FIG. 6.

Referring to FIGS. 6 and 7, each blade member 88 of the knife 86 is a generally planar member. The blade members 88 define spaces in the form of respective slots 98 to improve flexibility of the cutting edge 90. The slots 98 extend from the outer edges 100 of the knife 86 towards the centre line of the knife so that in plan, the blade members 88 are generally U-shaped. The inner ends of the slots 98 are disposed opposite the inner ends of the second and third sections 94, 96 of the second cutting edge 90 where they join the respective outer ends of the first section 92. Respective arms 102 of the U-shaped blade members 88 that define the second and third sections 94, 96 of the second cutting edge 90 are bent upwardly along respective lines 104 that extend from the outer ends of the first section 92 to the inner ends of the slots 98. The resulting configuration is a generally L-shaped planar main body with the arms 102 bent out of the plane of the main body at an angle of 5°.

The blade members 88 are provided with through-holes 106 so that they can be secured to the support surfaces 84 by means of screws, bolts or the like engaging in tapped holes provided in drum 80.

As shown in FIGS. 3 and 5, when the blade members 88 are secured to a support surface 84, the front section of the knife 86 projects beyond the periphery of the drum 80. Thus, the second cutting edge 90 is cantilever supported by the support surface with a flat portion of the blade disposed between the holes 106 and the cutting edge 90 so as to provide additional flexibility to the knife 86.

In use, the web 20 of cigarette paper is fed by the web feeder 12 into the nip 30 defined between the first and second rotary carriers 26, 28. The web 20 is drawn between the contra-rotating first and second rotary carriers. As a knife 86 approaches the nip 30, the second cutting edge 90 engages the web 20 and cooperates with a first cutting edge 62 to shear through the web. During the cut, the second cutting edge 90 enters a recess 74 that is defined by the corresponding first cutting edge 62 and the leading edge 60 of the following cutting plate 54. The cutting edges 62, 90 commence cutting at their respective second 68, 94 and third 96, 66 sections simultaneously, and as rotation of the rotary carriers 26, 28 continues, the shear progresses inwardly from both sides until the cutting edges 62, 90 move apart from one another. The cantilever support of the front sections of the knives 86 projecting from their support surfaces and the cantilever support of the arms 102 from the planar main bodies of the blade members 88 provides knife flexibility so that second cutting edges 90 are able to deflect away from the cutting plates 54 to prevent undue interference and allow the cutting edges 62, 90 to effectively shear through the web 20 of cigarette paper Referring to FIG. 8, a blank 34 cut from the web 20 of cigarette paper has a leading edge 110 and a trailing edge 112. Each cut made by a cooperating pair of cutting edges 62, 90 forms the trailing edge 112 of a blank 34 that is newly separated from the web by the cut and the leading edge 110 of the web/next blank. The cuts extend across the full width of the web 20 between the longitudinally extending sides of the web, which form the sides 114 of the web/blank. As can be seen from FIG. 8, the width w of the blank 34 is greater than length l of the blank. Although not limited to this value, in the illustrated example, the width is approximately 4.5 times greater than the length. In one example, the width may be approximately 116 mm and the length 27 mm.

Figure 8:
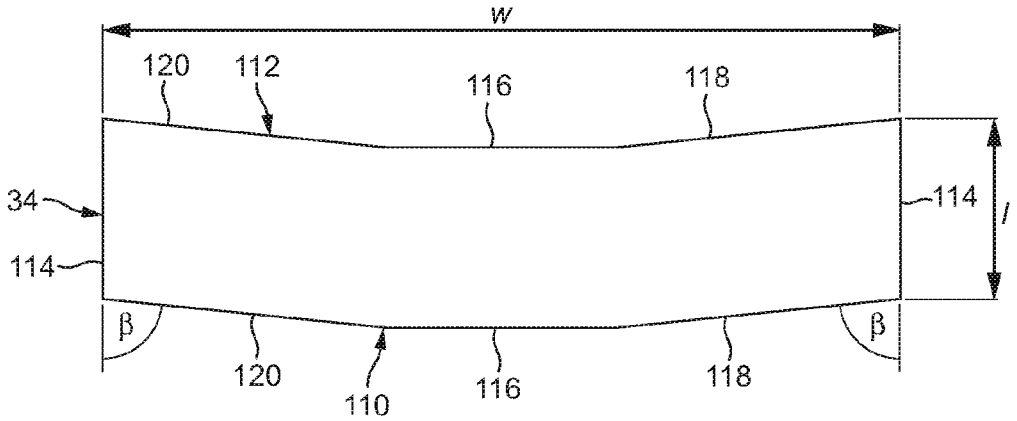
FIG. 8 is a plan view of a blank cut from a continuous web of cigarette paper by the cutting apparatus of FIG. 3.

Unlike the rectangular blanks formed in cigarette making machines by conventional cutting processes, the blanks 34 are not rectangular and have contoured rather than straight leading and trailing edges 110, 112. As can be seen in FIG. 8, the non-rectangular blank becomes narrower in width towards its leading edge 110. This facilitates rolling the blank at the rolling drum, since rolling can start at a region of narrower width. In this way, the patch can be kept wrinkle-free during rolling, even for very wide tipping patches. It will be appreciated that the cutting edges of the cutting apparatus could alternatively be adapted so that the blank becomes narrower towards its trailing edge rather than its leading edge to achieve the same effect.

Moreover, although the blank of FIG. 8 has central first sections 116 oriented perpendicular to the sides 114 of the blank, these are not essential. In alternative embodiments, the cutting edges are shaped to provide a blank having V-shaped leading and trailing edges. Since such a blank becomes narrower towards either its leading or trailing edge rolling of the blank is facilitated for the reasons explained above. To form such a blank, one or both cutting edges may have a corresponding V-shaped edge and thus may have less than three sections.

Turning to a more detailed description of the blank 34 of FIG. 8, as shown the leading and trailing edges 110, 112 have a shallow flat bottomed V-shaped profile corresponding to the profile of the first and second cutting edges 62, 90. Thus, the leading and trailing edges 110, 112 have centrally disposed first sections 116 that are disposed perpendicular to the sides 114 of the blank and second and third sections 118, 120 that extend outwardly from the centre of the blank to the sides 114. In FIG. 8, the angle β formed between the second and third sections 118, 120 and respective sides 114 is 85°. More generally, the angles of inclination of the second and third sections 118, 120 are determined by the angles that the second and third sections 68, 66 of the first cutting edge 62 make with the first section 64, and by the angles at which the arms 102 are bent out of the plane of the main body of the knife 88.

As will be understood from the foregoing, according to various embodiments of the invention the cutting edges of the rotary shear cutting apparatus are shaped so as to provide a non-rectangular blank. Alternatively, or in addition, in some embodiments, a cutting edge may be appropriately oriented for forming a non-rectangular blank by arranging the cutting edge at a particular fixed orientation relative to its corresponding rotary carrier, for example by orienting the blade carrying the cutting edge at a suitable angle relative to its drum.

Figure 9:
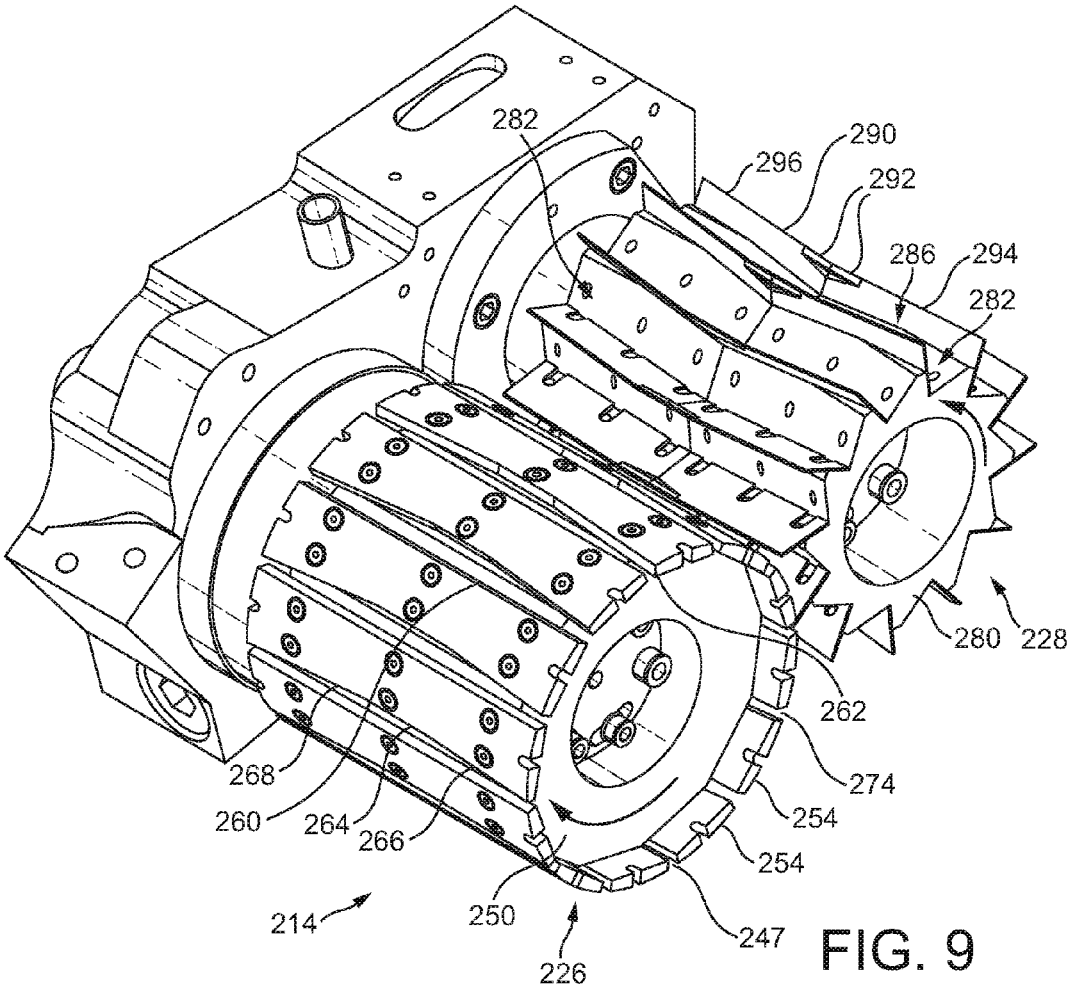
FIG. 9 is a perspective view of another cutting apparatus that may be used in the cigarette making apparatus shown in FIG. 1.

An example of a cutting apparatus 214 which employs such an angle-mounting will now be described with reference to FIGS. 9 and 10. It will be understood that the cutting apparatus 214 may be used in the cigarette assembly apparatus shown in FIGS. 1 and 2.

There are many parts of the cutting apparatus 214 that are the same as or similar to parts of the cutting apparatus 14. In the description that follows like, or similar, parts will be referenced with the same reference numerals incremented by 200 and may not be described in detail again.

The cutting apparatus 214 comprises a first rotary carrier 226 and a contra-rotating second rotary carrier 228. The first rotary carrier 226 carries a plurality of cutting plates 254 secured at spaced intervals about the circumference of a drum 250. The configuration of the cutting plates 254 corresponds to that of the cutting plates 54 shown in FIG. 4. Thus the cutting plates 254 have a leading edge 260 and a trailing edge that defines a first cutting edge 262 of the cutting apparatus 214. The first cutting edge 262 has three sections, comprised of a centrally disposed first section 264 and second and third sections 268, 266. The second and third sections 268, 266 extend at an angle (e.g: 5°) to the first section so that the first cutting edge 260 is contoured rather than straight. The first cutting edge 262 has a shallow flat-bottomed V-shaped profile. Recesses 274 are defined between the leading edges 260 and facing cutting edges 262 of adjacent cutting plates 254.

The second rotary carrier 228 comprises a drum 280 formed with a plurality of asymmetric V-shaped grooves 282 extending in the widthways direction of the drum at equi-spaced intervals about the circumference of the drum. The shorter side of each groove 282 defines a support surface for a knife 286. The knife 286 comprises two blade members 288 disposed side-by-side to define a continuous second cutting edge 290 of the cutting apparatus 214. In this example, the support surfaces have a V-shaped lengthways extending profile. Each side of the V-shaped profile of the support surfaces is angled (at e.g: 5°) to a circumferentially extending centreline of the second rotary carrier 228. In this way, the knives 286 are angle-mounted on the rotary carrier 228.

Figure 10:
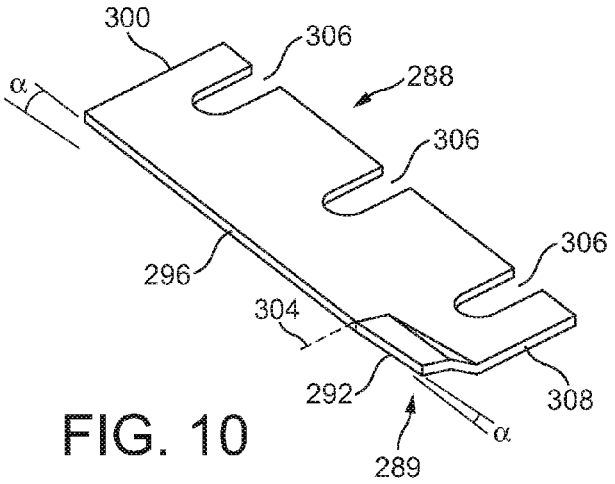
FIG. 10 is a perspective view of a blade member of a knife of the cutting apparatus of FIG. 9.

As best seen in FIG. 10, the blade members 288 each comprise a generally planar member that has a portion 289 that is bent out of the plane of member. Each blade member 288 defines one half of the second cutting edge 290 and specifically one of the second and third sections 294, 296 of the cutting edge and one half of the first section 292. As shown, the portion forming a part of the first section 292 of the second cutting edge is inclined at an angle α of 5° to the third section 296.

The portion 289 of the blade members 288 is inclined at an angle α (of e.g: 5°) to the plane of the blade member from a line 304 that extends through the point at which the first section 292 joins the second or third section 294, 296 to an inner edge 308 of the blade member In a modification of the blade members 288, instead of forming the portion 289 by bends as shown in FIG. 10 such that the edge 308 includes an S-shaped bend, a slit may be cut extending generally parallel to the first section 292 of the cutting edge and then a bend formed along the line 304. The angle α may again be 5°.

In the examples shown in FIG. 10, the configuration of the blade members is such that the portions that form the first section 292 of the second cutting edges 290 are relatively stiffer than the portions forming the second and third sections. This is not essential. In other examples, the portions of the blade members that define the second and third sections of the second cutting edge may be made relatively stiffer than the portions that define the first section. For example, referring to FIG. 10, the portion of the blade member 288 that defines the third section 296 of the second cutting edge may be bent out of the plane of the otherwise generally planar blade member in analogous fashion to the portion 289 and the portion defining one half of the first section 292 may be planar.

Figure 11:
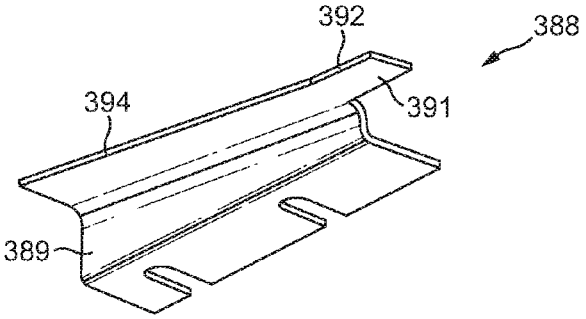
FIG. 11 is a perspective view of another blade member of a knife that may be used with the cutting apparatus.

In another example shown in FIG. 11, a blade member 388 that may be paired with a mirror image blade member to form a knife for a cutting apparatus having a main body portion 389 that is bent so that it has a generally S-shaped profile. Flexing of the cutting edge of the knife is facilitated by the S-shaped profile. In addition, in the example of FIG. 11, an ear 391 projects from one side of the main body portion 389. One half of the first section 392 of a second cutting edge formed by a mirrored pair of blade members 388 is defined by the front edge of the ear 391. The second section 394 of the second cutting edge is defined by the front edge of the main body portion 389. The support for the second section 394 provided by the main body portion 389 is stiffer than the support provided for the first section 392 by the ears 391. Thus, the first section 392 of the second cutting edge will be more flexible than the second and third sections. Although FIG. 11 shows both an ear 391 and an "S-bend" to improve flexibility, it will be understood that some embodiments may provide only one of these features (ie: "ear" or "S-bend") in one or more of the blades. An ear and/or S-bend may in some embodiments be provided together with other measures to improve flexibility, for example the provision of a slot in the blade, or cantilevered support of the blade or certain parts of the blade as discussed above.

Figure 12:
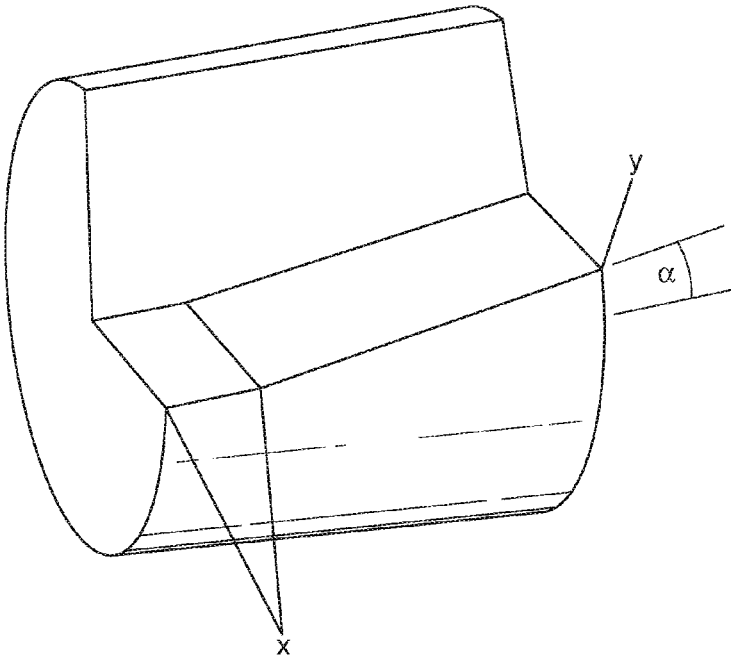
FIG. 12 is a schematic illustration of the geometry of an exemplary knife and counter-knife.
Figure 13:
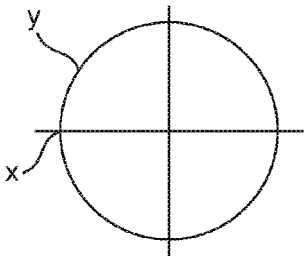
FIG. 13 illustrates the angular travel made by a rotary carrier between commencement and completion of a cut.

The cutting apparatus described with reference to FIGS. 1 to 11 can reliably form contoured cuts with angles β of 85° (See FIG. 8). In some cases it may however be desirable to have a lower value for the angle β so as to further facilitate rolling of the eventual patch. However, it has been found that if the angle β becomes too low, in practice an offset occurs between the blades so that the blades do not contact over the full extent of the desired cut. To illustrate the issue, FIG. 12 shows a schematic illustration of the geometry of an exemplary knife and counter-knife in a case in which the angle β is 80°. The resultant angle of inclination a of the outer sections of the first cutting edge to the centrally disposed first section is 10° as opposed to the 5° angle described with reference to FIGS. 1 to 11. FIG. 13 illustrates the angular travel that must be made by the first rotary carrier between the commencement of the cut at points Y on the first cutting edge and the completion of the cut at point X. This is significantly greater than the angular travel required for a 5° and the smaller the angle β the greater problem becomes. If the angle becomes too low, it is found that the blades do not contact over the full extent of the desired cut.

One solution to this issue is to provide a first rotary carrier having a concave shape to ensure that the blades contact over the full extent of the cut.

Figure 14:
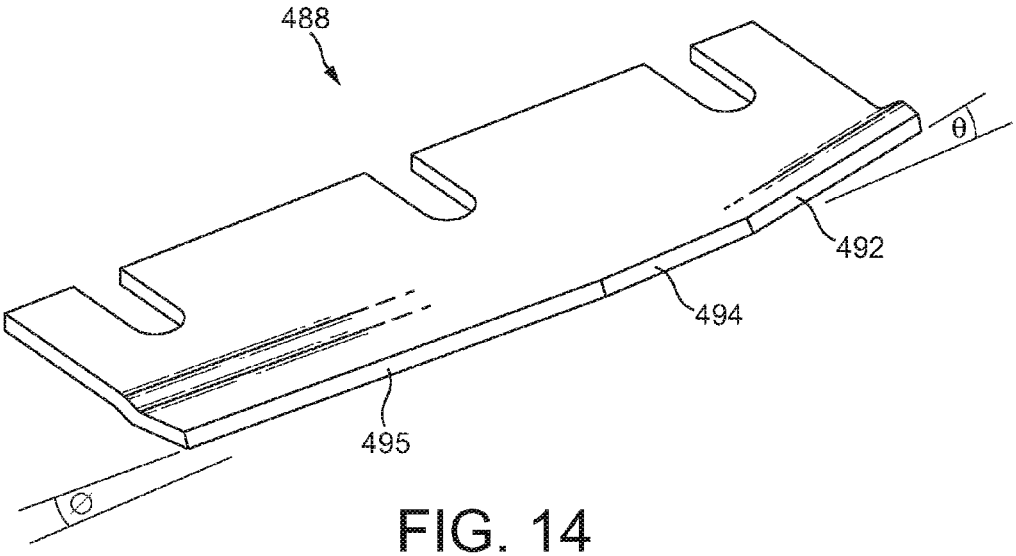
FIG. 14 is a perspective view of a blade member of a knife for a cutting apparatus.

An alternative solution is to lift a portion of the blade away from the plane of the blade so that the blades contact over the full extent of the cut. FIG. 14 illustrates an exemplary blade member 488 which has been modified in this way to ensure suitable contact between knife and counter-knife for low values of β, e.g: 80°. The blade member 488 of FIG. 14 forms one half of a knife for a cutting apparatus similar to the cutting apparatus 14, 214. A second cutting edge formed by two blade members 488 will comprise a centrally disposed first section 492 with each blade member defining one half of the first section. The second cutting edge will further comprise second and third sections as in the previous examples (the second section 494 can be seen in FIG. 14). The second and third sections extend outwardly from the respective outer ends of the first section 492. The second cutting edge is completed by fourth and fifth sections. The fourth and fifth sections respectively extend from the second and third sections to the outermost ends of the cutting edge to complete the second cutting edge. The fourth section 495 can be seen in FIG. 14.

As shown, the second section 494 of the blade member 488 is inclined at an angle θ to the first section 492. The fourth section 495 is inclined at an angle θ to the section 494. As illustrated by FIG. 14, the angle θ is greater than the angle θ. Similarly the third section is inclined at an angle θ to the first section and the fifth section is inclined at an angle θ to the third section.

As mentioned above, the blade member 488 of FIG. 14 forms one half of a knife and can be regarded as "left hand" blade member. The other half of the knife is formed by a corresponding "right hand" blade member. The two blade members together define a second cutting edge. In embodiments, the corresponding counterpart first cutting edge may also be provided with corresponding first, second, third, fourth and fifth sections as described above.

The bend in the fourth section 495 of the blade member 488 ensures that the outer edges of the knife and counter knife engage and cut correctly, so that there is no need to provide a concave shape to the first rotary carrier.

In a shear knife cutting system, the knives must be able to flex during the cutting action. The forming of bends in the knives to provide the needed angles to produce the contoured cuts provides inherent stiffness that may prevent the knives from flexing during cutting. As disclosed in the examples, various measures for compensating for this inherent stiffness are envisaged. For example, the knives may be shaped to define spaces (e.g: slots) so that one of more parts of the knife can flex under cantilever support. Alternatively, or in addition one or more knives may be cantilever mounted on its respective carrier, with a flat portion of the knife provided between the carrier and the cutting edge to provide improved flexibility to the knife. Alternatively, or in addition, S-bends or "ears" may be provided to improve flexibility as discussed above. Thus, the provision of reliefs or flexible elements in the knife structure allows the knives to flex during cutting and the changes in cutting angle. As an alternative or in addition to forming the knives with differential stiffness areas and reliefs, a blade may be mounted in a resilient support structure on the second rotary carrier. For example, a blade member could be clamped to a support surface of the second rotary carrier by means of a clamping bar resting on the blade member and screws, bolts or the like passing through the clamping bar and blade member into tapped holes provided in the second rotary carrier. To provide a degree of resilience in the mounting, resiliently compressible members may be provided between the blade member and clamping bar or clamping bar and screw/bolt heads. Although not limited to this example, the resiliently compressible members may take the form of compression springs.

The knives or blade members may be manufactured in various ways. For example a suitable steel plate may be formed to the desired profile, heat treated to obtain the desired hardness and then finish ground. Alternatively, a hardened cutting edge, for example a tungsten carbide edge, may be bonded to a relatively flexible steel body member. Another alternative would be to make manufacture from tungsten carbide or another suitably hard material using powder technology processes such as sintering. It should be noted that in the preceding description of the knives, references have been made to bends. These should not be taken as necessarily referring to shapes formed by bending, but simply to the shape of the knife that may be obtained by bending or non-bending processes.

As will be understood from the foregoing, according to various embodiments of the invention, contoured cuts are produced by a shear cutting technique.

CLAUSES (This section of the specification forms part of the description, not the claims)

1. Cutting apparatus to cut discrete sections from a continuous web of material, said cutting apparatus comprising:

a first rotary carrier having a first axis of rotation and a width extending parallel to said first axis of rotation that defines a widthways direction of the first rotary carrier, said first rotary carrier being provided with a first cutting edge that extends in said widthways direction; and a second rotary carrier having a second axis of rotation and a width extending parallel to said second axis of rotation that defines a widthways direction of the second rotary carrier, said second rotary carrier being provided with a second cutting edge that extends in said widthways direction of the second rotary carrier, wherein said first and second cutting edges cooperate during rotation of said first and second rotary carriers to cut through a said continuous web that is fed between said first and second rotary carriers, said cut being transverse to a longitudinal axis of said web and each of said first and second cutting edges comprising angled sections whereby said cut comprises at least a first section and a second section that is angled respect to said first section.

2. Cutting apparatus according to clause 1, wherein said angled sections of said first and second cutting edges comprise a first section that extends parallel to the respective axes of rotation of said first and second rotary carriers and an outer section that is angled with respect to said axes of rotation.

3. Cutting apparatus according to clause 2, wherein said first and second cutting edges each comprise two said outer sections and said first section is disposed intermediate said outer sections.

4. Cutting apparatus according to clause 3, wherein said first and second cutting edges are configured to commence a said cut at said first sections and cut outwardly along said outer sections as said first and second rotary carriers rotate.

5. Cutting apparatus according to any of clauses 1 to 4, wherein said first and second cutting edges are symmetrical about respective centrelines of said cutting edges 6. Cutting apparatus according to any of clauses 1 to 5, wherein said first rotary carrier is provided with a recess adjacent and upstream of said first cutting edge and configured to receive said second cutting edge when said first and second cutting edges cooperate to cut through said continuous web.

7. Cutting apparatus according to clause 6, wherein said first rotary carrier comprises a cylindrical member, said first cutting edge is defined by a trailing edge of an elongate member that is secured to said cylindrical member and said recess is defined between said trailing edge and a leading edge of a second said elongate member disposed adjacent said trailing edge.

8. Cutting apparatus according to any of clauses 1 to 7, wherein said second rotary carrier comprises a cylindrical member and said second cutting edge is defined by a knife secured to said cylindrical member such that said second cutting edge is disposed radially outwardly of said cylindrical member.

9. Cutting apparatus according to clause 8, wherein said knife comprises a plurality of blade members disposed in side-by-side relation to define said second cutting edge.

10. Cutting apparatus according to clause 8 or clause 9, wherein said knife has respective support portions for said angled sections of said second cutting edge, said support portions having a different stiffness, whereby when said second cutting edge cooperates with said first cutting edge to cut through said continuous web a section of said second cutting edge supported by a relatively stiffer support portion is able to deflect less than a section of said second cutting edge supported by a relatively more flexible support portion.

11. Cutting apparatus according to clause 10, wherein said section of said second cutting edge supported by said relatively more flexible support portion is disposed in a plane and said relatively stiffer support portion comprises at least one bend whereby said section of the second cutting edge supported by said relatively stiffer support portion is disposed out of said plane.

12. Cutting apparatus according to clause 8 or clause 9, wherein said knife blade comprises a main body portion and a second portion of said knife blade that defines a said angled section of the second cutting edge is partially separated from said main body portion by a slot whereby said second portion is cantilevered from said main body portion.

13. Cutting apparatus according to clause 12, wherein said main body portion is disposed in a plane and said second portion is inclined with respect to said plane.

14. Cutting apparatus according to any of clauses 1 to 13, wherein said first cutting edge is hollow ground so that when said first rotary carrier is rotating, centrally disposed portions of said first cutting edge have a circumferential velocity that is lower than a circumferential velocity of respective outer end portions of said first cutting edge.

15. Cutting apparatus to cut discrete sections from a continuous web of material, said cutting apparatus comprising:

a first rotary carrier having a first axis of rotation and provided with a first cutting edge that has a first length and is contoured along said length; and a second rotary carrier having a second axis of rotation disposed parallel to and spaced from said first axis of rotation, said second rotary carrier being provided with a second cutting edge that has a second length and is contoured along said second length, wherein said first and second cutting edges cooperate during rotation of said first and second rotary carriers to cut through a said continuous web that is fed between said first and second rotary carriers to produce a contoured cut that severs a said discrete section from a leading end of said web, said first and second cutting edges being symmetrical about respective centrelines of said first and second cutting edges.

16. Cutting apparatus according to clause 15, wherein said second cutting edge is defined by a knife comprising two blade members disposed in side-by-side abutting relation, said centreline of said second cutting edge extending along said abutting sides.

17. Cutting apparatus according to clause 15 or clause 16, wherein said first and second cutting edges are arranged such that a said contoured cut commences at a centrally disposed section of said first cutting edge and progresses simultaneously outwardly from said centrally disposed section along said first cutting edge to respective outer ends of said first cutting edge.

18. A method of cutting discrete sections from a web of cigarette tipping paper, said method comprising:

feeding said web of cigarette tipping paper between two rotary carriers that carry complementary contoured cutting edges;

causing said rotary carriers to rotate such that relative movement of said contoured cutting edges causes said contoured cutting edges to shear through said web and define a contoured leading edge of said web and contoured trailing edge of a said discrete section cut from said web.

19. A method according to clause 18, comprising causing said complementary cutting edges to commence shearing through said web at a position at least adjacent a longitudinal axis of said web and simultaneously shear outwardly of said longitudinal axis to respective longitudinally extending edges of said web.

20. A method according to clause 19, wherein said contoured leading edge is symmetrical about said longitudinal axis.

21. A method according to clause 18, 19 or 20, wherein said contoured leading edge has a flat-bottomed V-shaped profile.

22. A method of cutting discrete sections from a continuous web of material, said method comprising:

feeding said web between two contoured cutting edges; and causing relative movement of said contoured cutting edges so that said contoured cutting edges shear through said continuous web of material, said cutting edges having respective centres and being symmetric about said centres 23. Cutting apparatus to cut discrete sections from a continuous web of material in a cigarette making machine, said cutting apparatus comprising:

a movable first member provided with a cutting edge configured to make a contoured cut; and a second member cooperable with said first member so that when a said web of material is fed between said first and second members successive said contoured cuts extending transverse to a longitudinal axis of said web are made to separate respective said discrete sections from a leading end of said web.

Many modifications and variations will be evident to those skilled in the art, that fall within the scope of the following claims:

The invention claimed is:

1. Rotary shear cutting apparatus to cut discrete non-rectangular portions from a web of smoking article sheet material, comprising:

a first rotary carrier provided with a first cutting edge;

a second rotary carrier provided with a second cutting edge, wherein said first and second cutting edges are configured to cooperate during rotation of said first and second rotary carriers to cut a non-rectangular portion from the web, wherein at least one of the first and second cutting edges comprise an inclined section, the inclined section being configured such that a section of the first and/or second cutting edge is disposed at a greater radial distance from the rotational axis of the first and/or second rotary carrier on which the first and/or second cutting edges are provided and to facilitate contact between the first and second cutting edges, the first and/or second cutting edges being configured such that a cut formed by the first and second cutting edges progresses inwardly.

2. Rotary shear cutting apparatus as claimed in claim 1, wherein a cut formed by said first and second cutting edges includes a cut which is angled with respect to the widthwise direction of said web.

3. Rotary shear cutting apparatus as claimed in claim 1, wherein the first and second cutting edges are configured to cooperate during rotation of said first and second rotary carriers to provide a cut comprising at least a first section, and a second section that is angled with respect to said first section.

4. Rotary shear cutting apparatus as claimed in claim 1, wherein the first and/or second cutting edges are shaped such that the cutting edges cooperate during rotation of the rotary carriers to cut said non-rectangular portion from said web.

5. Rotary shear cutting apparatus as claimed in claim 4, wherein at least one of said cutting edges deviates from being straight.

6. Rotary shear cutting apparatus as claimed in claim 5, wherein said first or second cutting edges comprises a first section and a second section angled relative to the first section.

7. Rotary shear cutting apparatus as claimed in claim 6, wherein said first or second cutting edges comprises a third section angled relative to the first section, said first section being disposed between the second and third sections.

8. Rotary shear cutting apparatus as claimed in claim 7, wherein said second and third sections are outer sections of the first or second cutting edges.

9. Rotary shear cutting apparatus as claimed in claim 7, wherein said second and/or third sections are angled so as to be disposed forward of the first section.

10. Rotary shear cutting apparatus as claimed in claim 7, wherein said first section is disposed in a plane and the second and/or third sections are angled so as to be inclined with respect to said plane.

11. Rotary shear cutting apparatus as claimed in claim 6, wherein at least one of said cutting edges is symmetrical around a centreline of the cutting edge.

12. Rotary shear cutting apparatus as claimed in claim 1, wherein at least one of said cutting edges is angle-mounted relative to its respective carrier such that the cutting edges are configured to cooperate to cut a non-rectangular portion from said web.

13. Rotary shear cutting apparatus as claimed in claim 1, wherein said first rotary carrier is provided with a recess adjacent and upstream of said first cutting edge and configured to receive said second cutting edge when said first and second cutting edges cooperate to cut said web.

14. Rotary shear cutting apparatus as claimed in claim 13, wherein said first rotary carrier comprises a cylindrical member, said first cutting edge is defined by a trailing edge of an elongate member that is secured to said cylindrical member and said recess is defined between said trailing edge and a leading edge of a second elongate member disposed adjacent said trailing edge.

15. Rotary shear cutting apparatus as claimed in claim 1, wherein at least one of the first and second cutting edges is defined by a cantilever mounted knife.

16. Rotary shear cutting apparatus as claimed in claim 1, wherein at least one of said cutting edges is defined by a blade having a flat portion provided between the rotary carrier and the cutting edge to provide flexibility to the blade.

17. Rotary shear cutting apparatus as claimed in claim 1, wherein at least one of said cutting edges is defined by a blade which is shaped to define one or more spaces which provide flexibility to the blade.

18. Rotary shear cutting apparatus as claimed in claim 17, wherein said one or more spaces comprises a slot formed in the blade.

19. Rotary shear cutting apparatus as claimed in claim 1, wherein at least one of said rotary carriers includes at least one resilient support.

20. Rotary shear cutting apparatus as claimed in claim 1, wherein the first and second cutting edges thereby cooperate to cut a non-rectangular portion which comprises a leading edge, a trailing edge and two sides, the leading or trailing edge comprising a section angled at an angle $\beta$ to a side, $\beta$ being less than 850.

21. Rotary shear cutting apparatus as claimed in claim 1, wherein said non-rectangular portion becomes narrower in width towards its leading or trailing edge.

22. Rotary shear cutting apparatus as claimed in claim 20, wherein the leading and trailing edges of the non-rectangular portion each comprise two or more sections which are angled with respect to one another.

23. Rotary shear cutting apparatus as claimed in claim 22, wherein the leading and trailing edges of the portion each comprise first, second and third sections, wherein the first section is disposed intermediate the second and third sections.

24. Rotary shear cutting apparatus as claimed in claim 23, wherein the first section is perpendicular to the sides of the portion and the second and third sections are angled with respect to the first section.

25. Rotary shear cutting apparatus as claimed in claim 1, wherein said second rotary carrier comprises a cylindrical member and said second cutting edge is defined by a knife secured to said cylindrical member such that said second cutting edge is disposed radially outwardly of said cylindrical member.

26. Rotary shear cutting apparatus as claimed in claim 1, wherein at least one said first and second cutting edges is defined by two blade members disposed in side-by-side relation.

27. Rotary shear cutting apparatus as claimed in claim 1, wherein said first and second cutting edges are configured to provide a shear cut which progresses inwardly from one or more initial points of contact between the first and second cutting edges.

28. Apparatus for assembling smoking articles having one or more sheet material wrappers, comprising:

a rotary shear cutting apparatus as claimed in claim 1; and a wrapping device configured to receive a non-rectangular portion of sheet material cut by said rotary shear cutting apparatus, wherein said wrapping device is configured to wrap said non-rectangular portion of sheet material to form a wrapped layer of said smoking article.

29. Apparatus for assembling a smoking article as claimed in claim 28, wherein said rotary shear cutting apparatus is configured to cut discrete non-rectangular tipping patches from a web of tipping material and wherein said wrapping device is configured to join said one or more rods of smokeable material to one or more further rod articles using said non-rectangular tipping patch.

30. Apparatus for assembling a smoking article as claimed in claim 28, wherein said wrapping device is configured to form a rod assembly comprising first and second rods of smokable material and one or more further rod articles, and is further configured to wrap said non-rectangular patch of sheet material around said rod assembly to form a wrapped rod assembly; further comprising a rod-severing device to sever said wrapped rod assembly to form two smoking articles.

* * * * *